US006024279A

United States Patent [19]

McGary et al.

[11] Patent Number: 6,024,279

[45] Date of Patent: *Feb. 15, 2000

[54] BULK CONTAINER FORMED FROM BLANK HAVING T-SHAPED SLOTS SEPARATING CLOSURE FLAPS

[75] Inventors: Gregg D. McGary, Beloit; Robert C. Murphy, Canton, both of Ohio

[73] Assignee: Georgia-Pacific Corp., Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/962,243

[22] Filed: Oct. 30, 1997

[51] Int. Cl.[7] ..... B65D 5/10

[52] U.S. Cl. ..... 229/199; 229/920; 229/939

[58] Field of Search ..... 229/198, 199, 229/198.2, 930, 939, 920, 182.1, 182; 220/62

[56] References Cited

U.S. PATENT DOCUMENTS

| | | | |
|---|---|---|---|
| 278,851 | 6/1883 | Bauer . | |
| 956,046 | 4/1910 | Davis | 229/920 X |
| 1,838,098 | 12/1931 | Holbrook | 220/62 X |
| 1,923,928 | 8/1933 | Jacobs | 229/920 X |
| 1,992,087 | 2/1935 | Miller et al. . | |
| 2,141,752 | 12/1938 | Hoarle . | |
| 2,279,670 | 4/1942 | Ford et al. | 229/120 X |
| 2,306,328 | 12/1942 | Biberthaler | 229/154 X |
| 2,317,223 | 4/1943 | Rottman . | |
| 2,807,401 | 9/1957 | Smith | 229/120 |
| 2,858,969 | 11/1958 | Williams | 229/920 X |
| 3,098,600 | 7/1963 | Hagan et al. | 229/920 X |
| 3,178,093 | 4/1965 | Wasyluka | 229/182 X |
| 3,425,543 | 2/1969 | Harvey | 229/182.1 X |
| 3,469,762 | 9/1969 | Torre | 229/920 X |
| 3,559,876 | 2/1971 | Conescu . | |
| 3,698,548 | 10/1972 | Stenzel et al. . | |
| 3,964,607 | 6/1976 | Wagner | 206/427 |
| 4,260,442 | 4/1981 | Ford et al. | 229/199 X |
| 4,635,815 | 1/1987 | Grigsby | 229/199 X |
| 4,804,138 | 2/1989 | McFarland | 229/199 X |
| 5,495,727 | 3/1996 | Strong et al. | 229/119 X |

FOREIGN PATENT DOCUMENTS

| | | | |
|---|---|---|---|
| 7903723 | 11/1980 | Netherlands | 229/120 |

*Primary Examiner*—Stephen P. Garbe
*Assistant Examiner*—Tri M. Mai
*Attorney, Agent, or Firm*—Banner & Witcoff, Ltd.

[57] ABSTRACT

A bulk container is formed from a blank of corrugated sheet material having wall fold lines demarcating end wall panels and side wall panels, and flap fold lines demarcating top and bottom closure flaps. A T-shaped slot in the blank separates adjacent closure flaps from one another. A first portion of each slot extends inwardly from the free outer edges of the closure flaps and terminates at a second portion which extends substantially perpendicular to the first portion. The first portion of each slot is substantially aligned with a corresponding wall fold line. The second portion of each slot extends substantially colinearly with a flap fold line. The slots reduce binding and bunching of the thick multilayer reinforced walls found in conventional bulk container constructions, and at the same time avoid formation of through-holes at the corners of the container.

16 Claims, 5 Drawing Sheets

BULK CONTAINER FORMED FROM BLANK HAVING T-SHAPED SLOTS SEPARATING CLOSURE FLAPS

FIELD OF THE INVENTION

The present invention is directed to folding container constructions, and, more particularly, to corrugated bulk containers and blanks therefor.

BACKGROUND OF THE INVENTION

Corrugated bulk containers typically comprise side and end walls formed of multiple corrugated layers laminated together to provide extra thickness. Closure flaps are provided which, when folded, comprise the top and bottom of the bulk containers. The closure flaps typically comprise fewer layers than the side and end walls and are folded into an overlapping relation with one another, providing a double thickness in the overlapping regions.

Conventionally, the closure flaps are separated from one another by a simple linear slot extending from an outer edge of the closure flaps to an inner edge of the closure flaps, in alignment and colinear with fold lines demarcating adjacent side and end walls. A problem with this conventional design is binding and bunching of the thick laminated walls at the corners of the container when the blank is folded, thus hampering the folding operation. These corners are also susceptible to fraying and tearing at the ends of these slots, resulting in a sloppy appearance.

U.S. Pat. No. 1,992,087 to Miller et al. and U.S. Pat. No. 2,317,223 to Rottman disclose the use of circular eyes or cutouts at closure flap corners. The Rottman cutouts are intended to reduce tearing. The circular eyes of Miller et al. purport to allow free rounding or bending of a transparent material without cracking, bulging or wrinkling. A problem with the use of circular cutouts between closure flaps of bulk containers is the creation of through-holes at the corners of the folded container, allowing partial exposure of the interior of the container.

SUMMARY OF THE INVENTION

In view of the foregoing it is an object of the present invention to provide a bulk container configuration which reduces or overcomes the aforesaid difficulties inherent in prior known bulk containers. It is a more specific object of the present invention to provide a bulk container configuration which facilitates folding of a container blank to produce a finished container, and which reduces tearing and fraying of the container corners during formation and use, to improve the appearance of the container.

In accordance with a first aspect of the invention, a box formed from a blank of foldable material comprises a pair of adjacent walls folded about a wall fold line, demarcating the adjacent walls, to form a box corner. A pair of closure flaps extend generally along and orthogonal to respective ones of the adjacent walls, in overlapping relation to each other. A flap fold line extends generally perpendicular to the wall fold line and demarcates the pair of closure flaps from the respective walls along which the closure flaps extend. An elongated slot extends generally along the flap fold line and across the wall fold line, the slot serving to reduce bunching of the foldable sheet material in the corner and being substantially closed-off by overlapping portions of the closure flaps.

In accordance with another aspect of the invention, a blank of foldable material for forming a box comprises a pair of adjacent wall panels foldable about a wall fold line, demarcating the adjacent wall panels, to form a box corner. A pair of flap panels extends generally along respective ones of the adjacent wall panels, for folding into positions generally orthogonal to the wall panels and in overlapping relation with each other. A flap fold line extends generally perpendicular to the wall fold line and demarcates the pair of flap panels from the respective wall panels along which the flap panels extend. The flap panels are separated from each other by a generally T-shaped slot having a first portion extending between the flap panels in substantial alignment with the wall fold line, and a second portion extending generally along the flap fold line and across the wall fold line. The second portion of the slot serves to reduce bunching of the foldable sheet material when the walls are folded to form a box corner, and is substantially closed-off by overlapping portions of the flap panels when the flap panels are folded to positions orthogonal to the folded wall panels and in overlapping relation to each other.

In accordance with another aspect of the invention, a box precursor assembly comprises a pair of adjacent wall panels foldable about a wall fold line, demarcating the adjacent wall panels, to form a box corner. A pair of flap panels extend generally along respective ones of the adjacent wall panels, for folding into positions generally orthogonal to the wall panels and in overlapping relation with each other. A flap fold line extends generally perpendicular to the wall fold line and demarcates the pair of flap panels from the respective wall panels along which the flap panels extend. A reinforcing support panel is secured to and substantially covers an inside of each of the adjacent walls. The support panel extends across and is foldable along the wall fold line. The flap panels are separated from each other by a generally T-shaped slot having a first portion extending between the flap panels in substantial alignment with the wall fold line. A second portion extends generally along the flap fold line and across the wall fold line. The second portion of the slot serves to reduce bunching of the foldable sheet material when the walls are folded to form a box corner, and are substantially closed-off by overlapping portions of the flap panels when the flap panels are folded to positions orthogonal to the folded wall panels and in overlapping relation to each other.

Those skilled in the art will appreciate that bulk containers in accordance with the present invention can facilitate container manufacture and provide an improved appearance of the finished container which is not rapidly or easily degraded with use. These and additional features and advantages of the invention will be readily apparent and fully understood from the following detailed description of preferred embodiments, taken with reference to the appended drawings.

DETAILED DESCRIPTION OF THE PREFERRED EMBODIMENTS

Bulk containers are typically formed of multiple layers of corrugated fiberboard laminated together to form a thick walled box. Corrugated fiberboard is die cut into sheets having a desired shape, and fold lines are scored on the sheets, demarcating separate end walls, side walls and top and bottom closure flaps, thus forming a blank. The sheets are then folded about the fold lines and glued, thereby forming a box.

Figure 1:
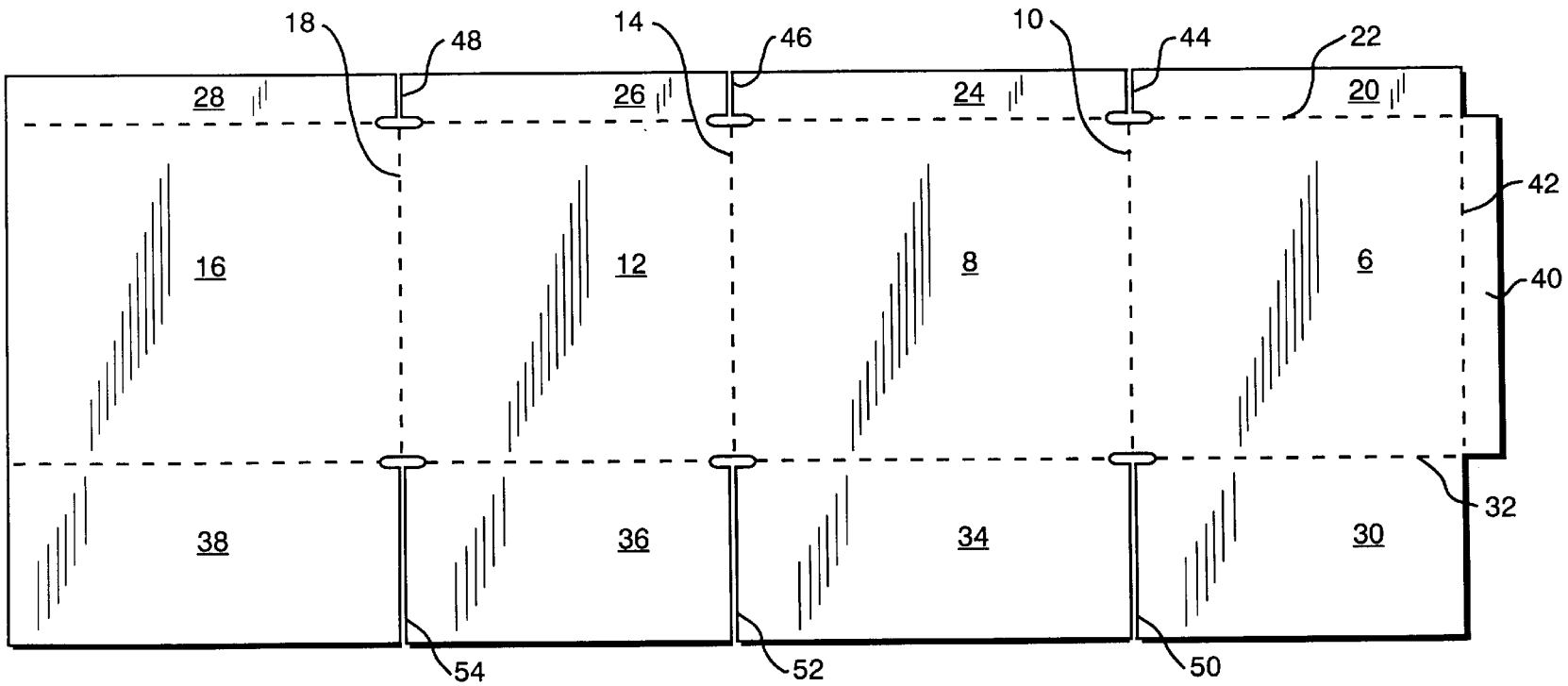
FIG. 1 is a plan view of a blank of corrugated fiberboard in accordance with the present invention.
Figure 4:
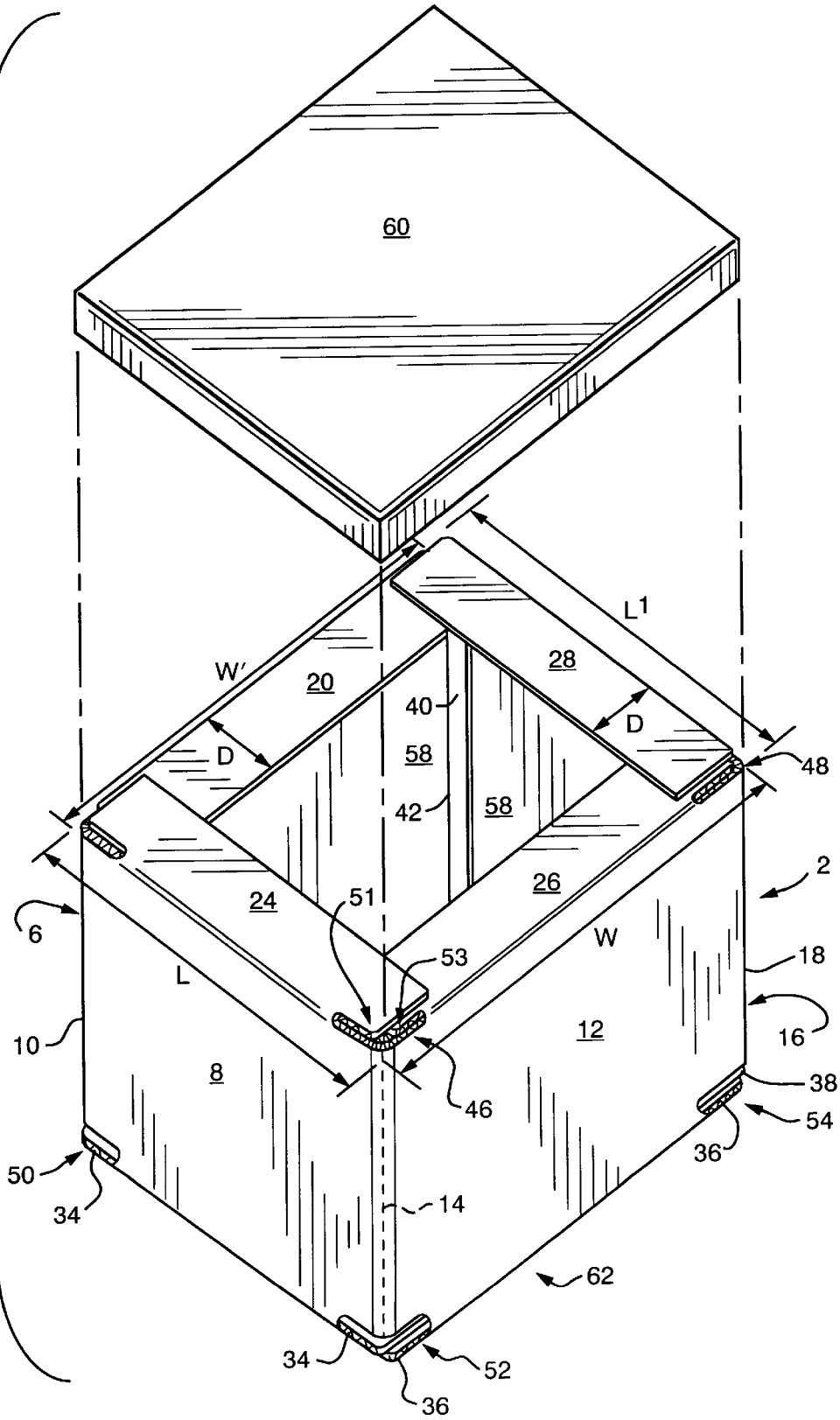
FIG. 4 is a schematic perspective view of a bulb container formed from the blank of FIG. 1 and a cover for placement thereon.

As shown in FIG. 1, a bulk container blank 4 in accordance with the present invention comprises a sheet which is due cut to a desired size. In a preferred embodiment, blank 4 is formed of two-ply corrugated fiberboard. Blank 4, when folded, will form a box-shaped container 2 as seen in FIG. 4 and described more fully below. Blank 4 comprises a first end wall panel 6, separated or demarcated from adjacent first side wall panel 8 by a first wall fold line 10, which facilitates subsequent folding and is formed by scoring. A second end wall panel 12 is similarly demarcated from adjacent first side wall panel 8 by a second wall fold line 14, and a second side wall panel 16 is demarcated from second end wall panel 12 by a third wall fold line 18. Wall fold lines 10, 14, 18 comprise partially compressed regions of blank 4 formed by scoring which facilitate the folding of blank 4 and form corners of container 2, as seen in FIG. 4. First end wall panel 6 and second side wall panel 16 are the endmost walls of blank 4, and are therefore adjacent to only one other wall panel when blank 4 is in its unfolded condition.

Closure flaps extend along upper and lower edges of the end and side wall panels, and are similarly separated or demarcated from the wall panels by scored fold lines. The closure flaps, when folded to their appropriate position, form the top and bottom of container 2, as seen in FIG. 4 and described in greater detail below.

As seen in FIG. 1, a first top flap 20 extends along the upper edge of first end wall panel 6. A second top flap 24 extends along the upper edge of first side wall panel 8. A third top flap 26 extends along the upper edge of second end wall panel 12, and a fourth top flap 28 extends along the upper edge of second side wall panel 16. The top flaps 20, 24, 26 and 28 are demarcated from the corresponding wall panels 6, 8, 12, 16 by a first flap fold line 22 extending along the length of blank 4.

A first bottom flap 30 extends along the lower edge of first end wall panel 6. A second bottom flap 34 extends along the lower edge of first side wall panel 8. A third bottom flap 36 extends along the lower edge of second end wall panel 12, and a fourth bottom flap 38 extends along the lower edge of second side wall panel 16. The bottom flaps 30, 34, 36, and 38 are demarcated from the corresponding wall panels 6, 8, 12, 16 by a second flap fold line 32 extending along the length of blank 4. A sealing flap 40 extends along the exposed vertical edge of first end wall panel 6, demarcated therefrom by a sealing flap fold line 42. Flap fold lines 22, 32 and sealing flap fold line 42 comprise partially compressed regions of blank 4 which facilitate the folding of blank 4.

Referring to blank 4 in its unfolded condition, first top flap 20 is separated from second top flap 24 by a first T-shaped slot 44. Third top flap 26 is similarly separated from second top flap 24 by a second T-shaped slot 46, and fourth top flap 28 is separated from third top flap 26 by a third T-shaped slot 48. Similarly, first bottom flap 30 is separated from second bottom flap 34 by a fourth T-shaped slot 50. Third bottom flap 36 is similarly separated from second bottom flap 34 by a fifth T-shaped slot 52, and fourth bottom flap 38 is separated from third bottom flap 36 by a sixth T-shaped slot 54. T-shaped slots 44, 46, 48, 50, 52, 54 allow top flaps 20, 24, 26, 28 and bottom flaps 30, 34, 36, 38 to be folded independently of one another. The T-shaped slots reduce the binding and bunching at the corners of the thick laminated walls of the bulk container to be formed.

Each T-shaped slot comprises a first portion extending, in substantial alignment with a respective wall fold line, from the free edges of the flaps between which it lies toward the interior of the sheet. The first portion terminates at a second portion which is substantially perpendicular to the first portion. Each second portion is preferably substantially colinear with a respective one of flap fold lines 22, 32, and arranged symmetrically about its respective wall fold line.

Figure 2:
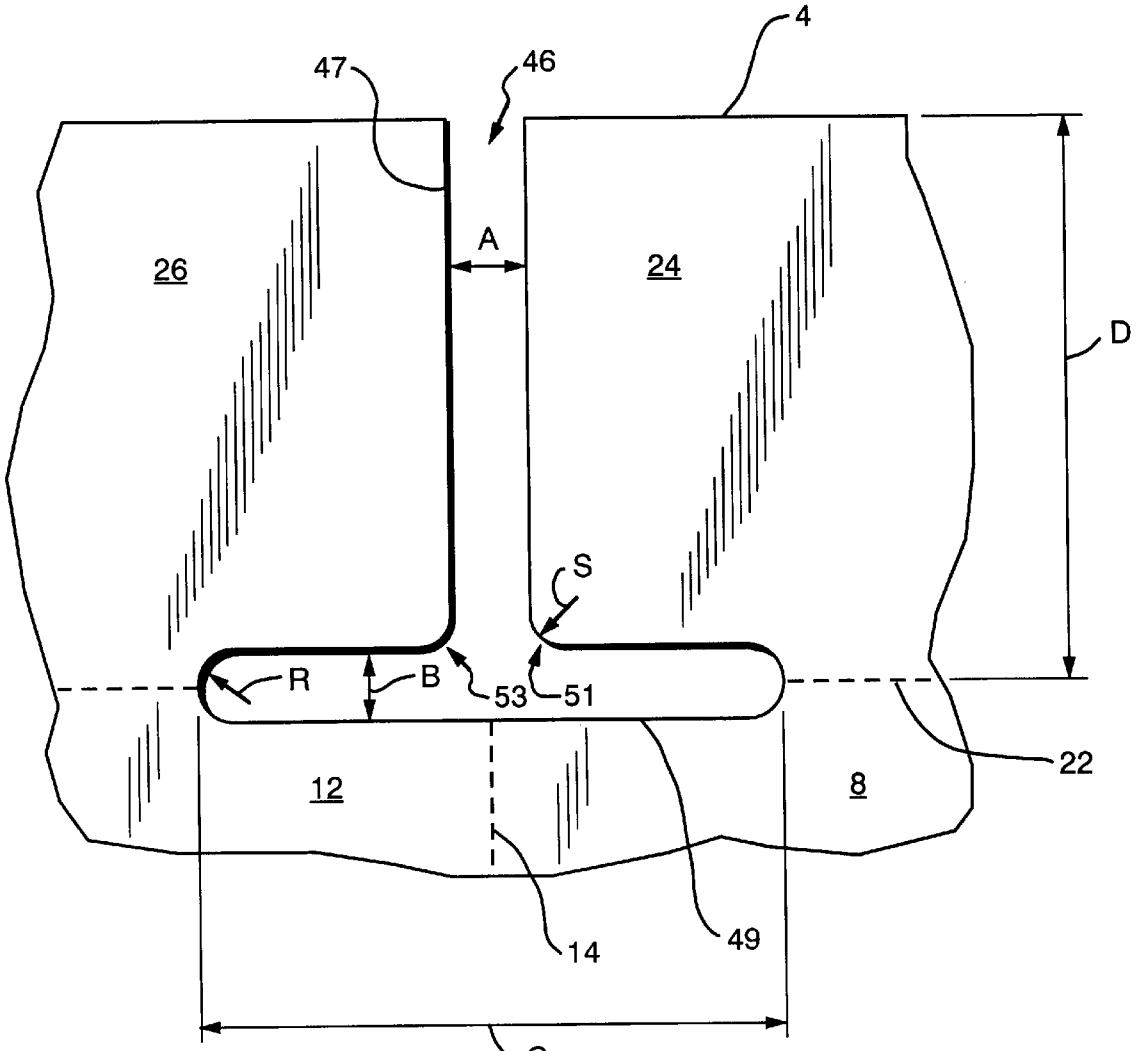
FIG. 2 is a broken-away close-up plan view of the blank of FIG. 1 showing a T-shaped slot included in the blank.

Second T-shaped slot 46 is shown in greater detail in FIG. 2 and is representative of the construction of the other T-shaped slots. Slot 46 comprises first portion 47 which extends from its first end at the outer edges of top flap 24 and top flap 26 toward the center of blank 4, in substantial alignment with second wall fold line 14. A second portion 49 of slot 46 is located at the second end of, and is substantially perpendicular to, first portion 47. Second portion 49 extends substantially colinearly with first flap fold line 22. The ends of second portion 49 are each formed with a radius R to reduce stress concentrations and tearing.

Figure 5:
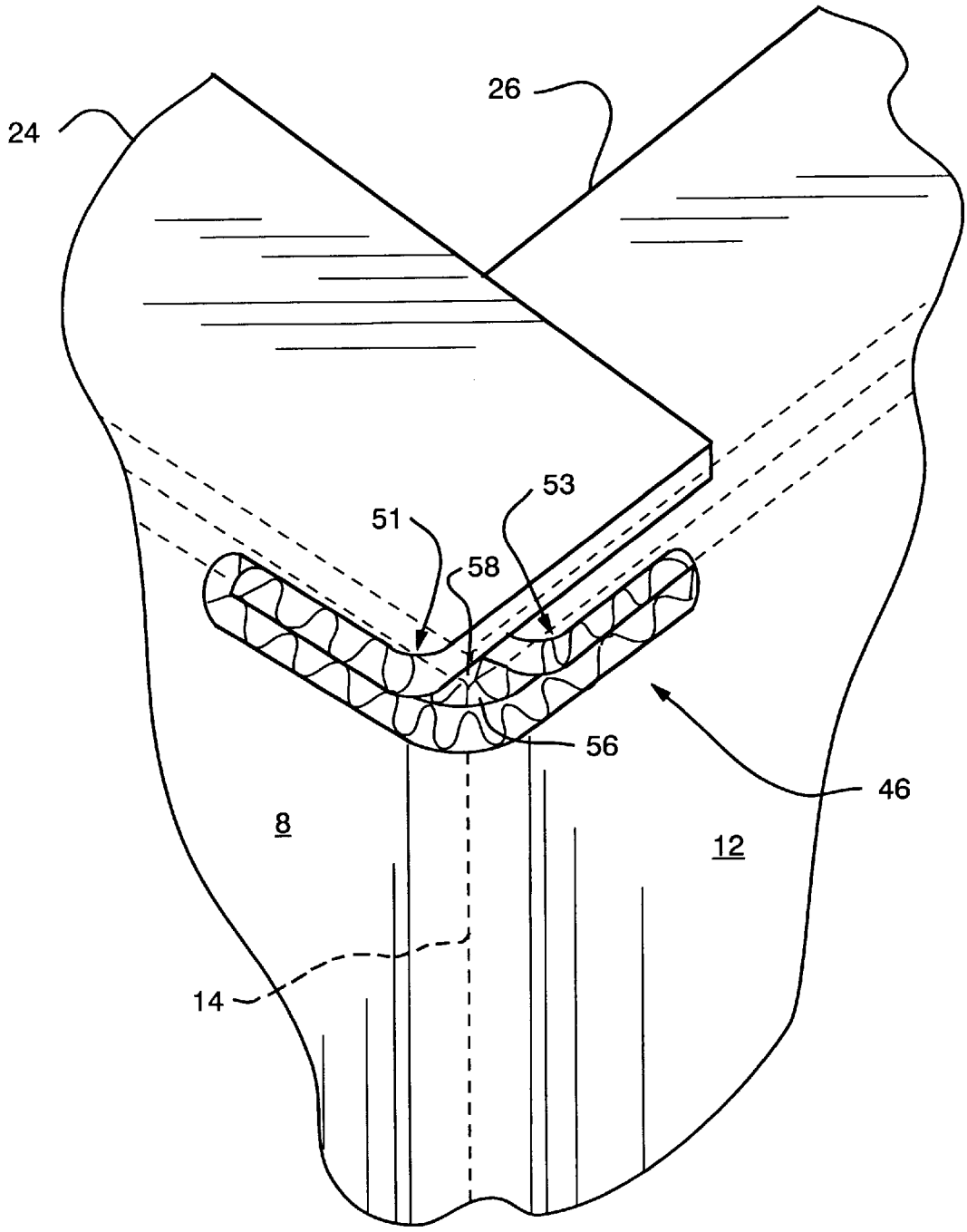
FIG. 5 is a close-up perspective view of an exterior corner of the container of FIG. 4.

Second portion 49, having a predetermined length and a radius R formed on its respective ends, helps to reduce tearing of the container when the flaps are folded into place, as well as when the finished container is in use. Corners 51, 53 of top flaps 24, 26, respectively, formed by the intersection of first portion 47 and second portion 49, are formed with a radius S to provide a more finished appearance. The improved appearance of the folded container is illustrated in FIGS. 4 and 5, where it can be seen that corners 51, 53 are rounded in a manner similar to the corner formed at second wall fold line 14, providing an overall smooth and rounded look for that corner.

In the illustrated embodiment, where blank 4 is formed of two-ply corrugated fiberboard, corners 51, 53 preferably have a radius S of approximately 3/16". First portion 47 preferably has a width A of approximately ½" and a length equal to and dependent on width D of top flaps 24, 26. Second portion 49 preferably has a width B of approximately ⅜", a length of approximately 2½", and a radius R of approximately 3/16".

As previously indicated, all of the T-shaped slots have a construction similar to that of second slot 46 as described above. Accordingly, the first portions of first and fourth slots 44, 50 are aligned with first wall fold line 10, the first portion of fifth slot 52 is aligned with second wall fold line 14, and the first portions of third and sixth slots 48, 54 are aligned with third wall fold line 18. The second portions of first and third slots 44, 48 are colinear with first flap fold line 22, and the second portions of fourth, fifth, and sixth slots 50, 52, 54 are colinear with second flap fold line 32.

Figure 3:
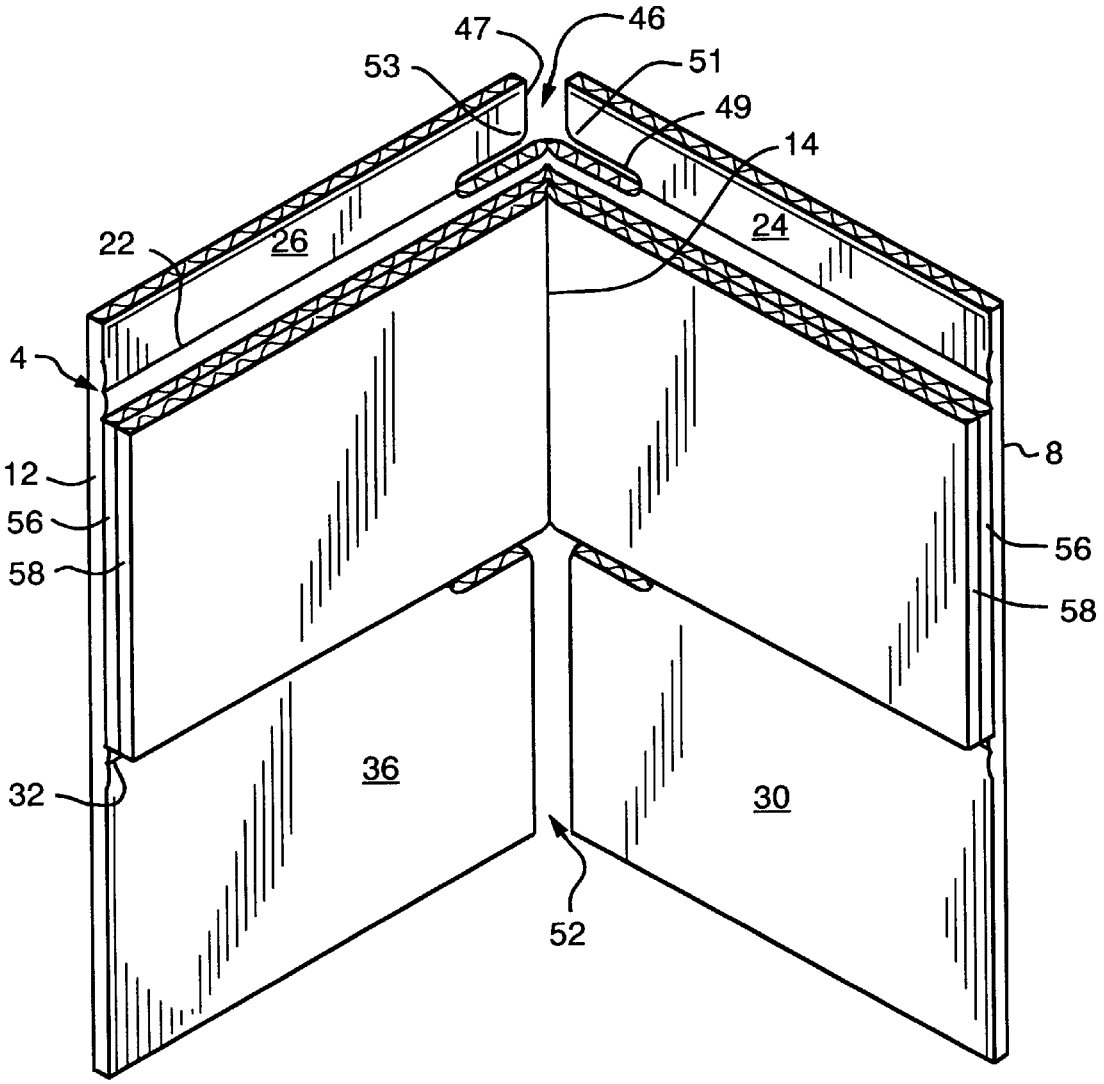
FIG. 3 is a broken-away perspective view, showing a folded interior corner of a bulk container formed from the blank of FIG. 1, with support panels laminated to the side and end walls.

In order to form a container having additional structural strength, an additional material layer or layers are preferably added to the end and side walls of bulk containers. As seen in FIG. 3, a first layer, or support panel 56, is adhesively secured to the interior surface of blank 4, and substantially covers the area of blank 4 comprising first and second end wall panels 6, 12 and first and second side wall panels 8, 16. A second support panel 58, being approximately equal in size to first support panel 56, is then adhesively secured to the interior surface of first support panel 56. The end and side walls of the resultant box precursor assembly, therefore, comprise a triple-laminated layer formed of a blank wall panel and two added support panels (each layer preferably comprising itself a two-ply corrugation), while the top and bottom flaps each comprise a single layer of two-ply corrugation. Panels 56, 58 are disposed slightly, and preferably approximately ⅛", below the lower edge of the second portions of T-shaped slots 44, 46, 48, and slightly, and preferably approximately ⅛", above the upper edge of the second portion of T-shaped slots 50, 52, 54. In the illustrated embodiment, with blank 4 and support panels 56, 58 each preferably formed of two-ply corrugated fiberboard, a two-ply total thickness is provided for the top and bottom flaps, and a six-ply total thickness is provided for the end and side walls.

Turning now to FIG. 4, a completed container 2 can be seen. End walls 6, 12 and side walls 8, 16 are each folded inwardly approximately 90° about the respective wall fold lines separating one from another, thereby forming a rectangular shaped box. Sealing flap 40, which extends along the exposed vertical edge of first end wall panel 6, is folded inwardly approximately 90° about sealing flap fold line 42, and adhesively secured along its outside surface to the inside surface of second side wall panel 16, thereby securing the walls of container 2 in their respective folded positions. In order to accommodate the thickness of second side wall panel 16 and support panels 56, 58, and allow sealing flap 40 to be folded along the interior of second side wall panel 16, length W' of first end wall panel 6 is made shorter than length W of opposed second end wall panel 12. In the illustrated embodiment, length w' is approximately ¼" shorter than length W.

In the illustrated embodiment, top flaps 20, 24, 26, 28 are folded downwardly approximately 90° in overlapping fashion toward the interior of container 2 such that they are substantially perpendicular to the side and end walls. Top flaps 20, 26 are folded first, with top flaps 24, 28 then folded in overlapping fashion over top flaps 20, 26 and secured thereto. A cover 60 of conventional corrugated construction is sized to be placed over container 2, providing protection for the contents.

Bottom flaps 30, 34, 36, 38 are each folded upwardly approximately 90° about flap fold line 32 in an overlapping fashion similar to the top flaps, and secured to one another to form bottom 62 of container 2. Bottom flaps 30, 34, 36, 38, top flaps 20, 24, 26, 28, and sealing flap 40 in the illustrated embodiment are preferably adhesively secured with glue, but may be stapled or secured via any other suitable fastening means.

The width D of top flaps 20, 24, 26, 28, in the illustrated embodiment, is preferably substantially smaller than both the width W and length L of container 2, such that when folded into position the top flaps extend inwardly only a short distance, forming a frame-like partial cover. The frame formed by top flaps 20, 24, 26, 28 provides additional strength around the perimeter of the upper edge of container 2. This additional strength can advantageously provide extra support for a stack of containers where stacked containers may be offset slightly from the containers upon which they are stacked, thereby reducing the change of buckling of the walls of the stacked containers. If desired, the top flaps may be configured, similar to the bottom flaps, to extend substantially completely across the top of the container, thereby avoiding the need for a separate cover.

Conversely, bottom flaps 30, 34, 36, 38 may be configured in a manner similar to top flaps 20, 24, 26, 28, such that when folded into position the bottom flaps extend inwardly only a short distance, forming a frame-like partial cover for the bottom.

The T-shaped slots of the invention (particularly the second portions thereof, extending colinear with the fold flap lines 22, 32) effectively prevent the binding and tearing corrugated material at six corners of the finished container, in contrast to the conventional simple linear slots separating adjacent closure flaps. The relatively narrow width of the second slot portions also allow the upper and lower edges of the laminated support panels, the side walls and the end walls to be at least partially covered by the top flaps and bottom flaps in the corners such that through-holes into the container are not formed. This can be seen clearly in FIG. 5 where second top flap 24 and third top flap 26 substantially cover the upper fluted edges of support panels 56, 58 proximate second wall fold line 14, and the thicknesses of the overlapping flaps 24 and 26 combine to substantially close-off (i.e, cover) the slot second portions. In a similar manner, through-holes are avoided on the bottom of the container, as can be seen in FIG. 4 where bottom flaps 36, 34 are overlapped proximate wall fold line 14. This arrangement provides an advantage over the circular cutouts of the prior art which, if sized large enough to effectively reduce the problem of bunching at the container corners, would create through-holes at the corners, thereby exposing the interior of the container.

First top flap 20 and fourth top flap 28 become adjacent to one another when container 2 is folded into its rectangular shape. As can be seen in the illustrated embodiment of FIG. 1, the two corners formed by the adjoined vertical edges of first top flap 20 and fourth top flap 28 do not, in this preferred embodiment, have a T-shaped slot associated therewith. In order to prevent bunching of the corrugated material at this corner, first side wall panel 16 and fourth top flap 28 have a length L' (FIG. 4) slightly shorter than length L of opposed first side wall panel 8 and second top flap 24. In the illustrated embodiment, where the flaps, walls and support panels have a two-ply thickness, length L' is approximately ½" shorter than length L. In operation, first top flap 20 is first folded downwardly and fourth top flap 28 is then folded in overlapping fashion over first top flap 20. Due to the shortened length L' of fourth top flap 28, there is a reduction in binding and bunching of the walls of the container in this corner. First bottom flap 30 and fourth bottom flap 38 similarly are adjacent one another when container 2 is folded, and the difference between length L and L' reduces the binding and bunching of material where these two flaps meet as well.

In light of the foregoing, those skilled in the art will readily understand that various modifications and adaptations can be made without departing from the scope and spirit of the invention as defined in the appended claims.

We claim:

1. A box formed from a blank of foldable material, said box comprising:

a pair of adjacent walls folded about a wall fold line, demarcating said adjacent walls, to form a box corner;

a pair of closure flaps extending generally along and orthogonal to respective ones of said adjacent walls, in overlapping relation to each other;

a flap fold line extending generally perpendicular to the wall fold line and demarcating the pair of closure flaps from the respective walls along which the closure flaps extend;

an elongated slot extending generally along said flap fold line and across said wall fold line, said slot serving to reduce bunching of the foldable sheet material in said corner and being substantially entirely closed-off by overlapping portions of said closure flaps, said elongated slot having a first elongate portion extending from said box corner generally along a first said adjacent walls and a second elongate portion extending from said box corner generally along a second of said adjacent walls; and a reinforcing support panel secured to and covering an inside portion of each of said adjacent walls, said support panel extending across and being folded along said wall fold line and having an edge extending parallel to said flap fold line across said wall fold line, said edge being spaced from said flap fold line and extending along and in close proximity to said first and second elongate portions.

2. A box according to claim 1, wherein said slot extends substantially co-linearly with said flap fold line.

3. A box according to claim 1, wherein said slot is arranged symmetrically about said wall fold line.

4. A box according to claim 1, wherein said flaps comprise partial closure flaps forming a reinforcing frame about a central box opening.

5. A box according to claim 1, wherein said flaps are closure flaps which overlap with each other to form part of a box bottom.

6. A box according to claim 1, wherein said sheet material comprises corrugated fiberboard.

7. A box according to claim 1, wherein said box is a rectangular box with pairs of adjacent walls and associated overlapping closure flaps forming eight box corners, said elongated slot being formed at at least six of said eight corners.

8. A box according to claim 1, wherein said support panel comprises a layer of corrugated fiberboard.

9. A box according to claim 1, wherein said closure flaps comprise partial closure flaps forming a reinforcing frame about a central box opening, said frame overlying a side edge of said support panel.

10. A box according to claim 1, wherein the slot has a length of approximately 2½".

11. A box according to claim 1, wherein the slot has a width of approximately ⅜".

12. A box according to claim 1, wherein opposed ends of the slot are formed with a radius.

13. A box according to claim 12, wherein the radius is approximately 3/16".

14. A box precursor assembly, comprising:

a pair of adjacent wall panels foldable about a wall fold line, demarcating said adjacent wall panels, to form a box corner;

a pair of flap panels extending generally along respective ones of said adjacent wall panels, for folding into positions generally orthogonal to said wall panels and in overlapping relation with each other;

a flap fold line extending generally perpendicular to the wall fold line and demarcating the pair of flap panels from the respective wall panels along which the flap panels extend; and a reinforcing support panel secured to and covering an inside portion of each of said adjacent walls, said support panel extending across and being foldable along said wall fold line and having an edge extending parallel to said flap fold line across said wall fold line;

wherein said flap panels are separated from each other by a generally T-shaped slot having a first elongate portion extending between said flap panels in substantial alignment with said wall fold line, and a second elongate portion extending generally along said flap fold line and across said wall fold line, said edge being spaced from said flap fold line and extending along and in close proximity to said second elongate portion, said second elongate portion of the slot serving to reduce bunching of the foldable sheet material when said walls are folded to form a box corner, and being substantially entirely closed-off by overlapping portions of said flap panels when said flap panels are folded to said positions orthogonal to the folded wall panels and in overlapping relation to each other.

15. A box precursor assembly according to claim 14, wherein said support panel comprises a layer of corrugated fiberboard.

16. A box precursor assembly according to claim 14, wherein said flaps comprise partial closure flaps forming a reinforcing frame about a central box opening when said flap panels are folded to said positions orthogonal to the folded wall panels and in overlapping relation to each other, said frame overlying a side edge of said support panel.

* * * * *